US007455377B2

(12) United States Patent
Espasa et al.

(10) Patent No.: US 7,455,377 B2
(45) Date of Patent: Nov. 25, 2008

(54) PRINTER HAVING ADJUSTABLE INK DELIVERY SYSTEM PRESSURE

(75) Inventors: Cesar Fernandez Espasa, San Diego, CA (US); Raul Perez, San Marcos, CA (US); Santiago Garcia-Reyero Vinas, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 247 days.

(21) Appl. No.: 11/081,492

(22) Filed: Mar. 16, 2005

(65) Prior Publication Data

US 2006/0209115 A1 Sep. 21, 2006

(51) Int. Cl.
*B41J 2/205* (2006.01)

(52) U.S. Cl. ..... 347/15; 347/14; 347/6

(58) Field of Classification Search ..... 347/15, 347/14, 6, 17, 84
See application file for complete search history.

(56) References Cited

U.S. PATENT DOCUMENTS 4,614,953 A * 9/1986 Lapeyre ..... 347/43
4,628,330 A 12/1986 Suga
5,880,748 A * 3/1999 Childers et al. ..... 347/6
6,042,208 A 3/2000 Wen
6,243,115 B1 6/2001 Baker et al.
7,040,729 B2 * 5/2006 Richards ..... 347/7
2002/0041315 A1 4/2002 Kubota
2004/0183876 A1 9/2004 Mizuno et al.
2004/0196326 A1 10/2004 Sasa
2004/0212655 A1 10/2004 Sasa
2005/0053502 A1 3/2005 Souza
2005/0157041 A1 * 7/2005 Inoue ..... 347/40

OTHER PUBLICATIONS

International Search Report for PCT/US2006/007934 dated Aug. 14, 2006 (2 pages).

* cited by examiner

*Primary Examiner*—Thinh H Nguyen

(57) ABSTRACT

An ink delivery system for a printer includes an ink reservoir, a printhead assembly, a pump configured to provide ink from the ink reservoir to the printhead assembly at a selected pressure, and a controller configured to adjust the selected pressure based on a characteristic of an image to be printed.

19 Claims, 3 Drawing Sheets

PRINTER HAVING ADJUSTABLE INK DELIVERY SYSTEM PRESSURE

BACKGROUND

A conventional inkjet printing system includes a printhead, an ink supply that supplies liquid ink to the printhead, and an electronic controller that controls the printhead. The printhead ejects ink drops through a plurality of orifices or nozzles toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization or firing chambers with small electric heaters, such as thin film resisters. Heating the ink causes the ink to vaporize and be ejected from the nozzles. Typically, for one dot of ink, a remote printhead controller typically located as part of the processing electronics of a printer, controls activation of an electrical current from a power supply external to the printhead. The electrical current is passed through a selected thin film resister to heat the ink in a corresponding selected vaporization chamber.

Inkjet technology is based on injecting ink through a nozzle by heating it to the boiling point. A bubble of air is formed that pushes some ink out of the nozzle of the printhead. As the ink is expelled from a nozzle, it leaves a small void of mass in the vaporization chamber from which it left. This creates a vacuum that pulls fresh ink into the vaporization chamber. With fresh ink in the vaporization chamber, the nozzle is ready to fire another ink drop. A subsystem known as the ink delivery system (IDS) is responsible for supplying the vaporization chamber with a fresh supply of ink. An IDS pump is used to provide pressure to supply ink to the vaporization chamber.

In ink demanding applications, if the ink pressure is too low, the vaporization chambers will not be refilled fast enough causing printhead starvation. One consequence of printhead starvation is that print quality degrades dramatically as some of the nozzles stop ejecting ink and white lines show up in the printed image. A second consequence of printhead starvation is that nozzles heat up very fast, which heats the printhead. Eventually, the printhead can experience a thermal shutdown resulting in the print job being stopped.

Typical solutions to these problems involve setting and maintaining a constant ink pressure that will allow the maximum flow rate of ink through the printhead. The maximun flow rate of ink through the printhead is determined by firing all nozzles at the maximum frequency. Most of the time, however, printheads do not fire all the nozzles at once. A more typical scenario is that only 5% to 20% of the nozzles fire most of the time and very rarely do 100% of the nozzles fire at once. Therefore, the IDS pump is producing an IDS pressure that is greater than required most of the time.

In order to maintain a higher pressure, the IDS pump runs more often and under greater load conditions than is really required most of the time. This in turn shortens the life of the IDS pump and decreases the overall reliability of the printing system. The only time that the conditions warrant the higher IDS pressure is when 100% of the nozzles fire. If the IDS pressure, however, is set to allow flow under the average use conditions, say 5% to 10%, then when the printhead fires a series of higher density images, the ink flow rate from the printhead would be insufficient. A printing system with a constant IDS pressure sets a pressure that is greater than the highest flow rate condition the printing system allows.

For these and other reasons there is a need for the present invention.

SUMMARY

One aspect of the present invention provides an ink delivery system for a printer. The ink delivery system comprises an ink reservoir, a printhead assembly, a pump configured to provide ink from the ink reservoir to the printhead assembly at a selected pressure, and a controller configured to adjust the selected pressure based on a characteristic of an image to be printed.

DETAILED DESCRIPTION

In the following Detailed Description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following Detailed Description, therefore, is not to be taken in a limiting sense, and the scope of the present invention is defined by the appended claims.

Figure 1:
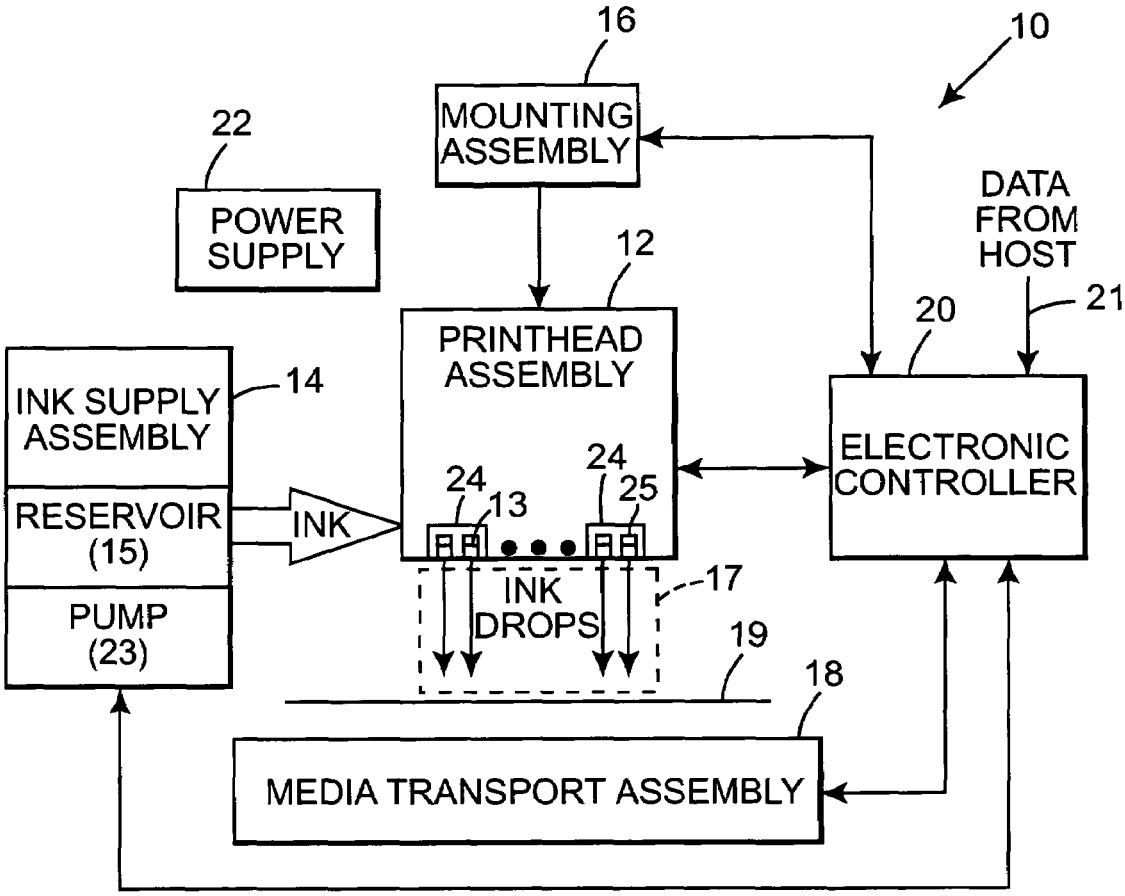
FIG. 1 is block diagram illustrating one embodiment of an inkjet printing system.

FIG. 1 illustrates one embodiment of an inkjet printing system 10. In one embodiment, inkjet printing system 10 adjusts ink delivery system (IDS) pressure based on the image density and nozzle firing frequency. Inkjet printing system 10 includes an inkjet printhead assembly 12, an ink supply assembly 14, a mounting assembly 16, a media transport assembly 18, and an electronic controller 20. At least one power supply 22 provides power to the various electrical components of inkjet printing system 10. Inkjet printhead assembly 12 includes at least one printhead or printhead die 24 that ejects drops of ink through a plurality of orifices or nozzles 13 toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 provides an ink delivery system (IDS) that supplies ink to printhead assembly 12 and includes a reservoir 15 for storing ink and a pump 23 to force the ink to inkjet printhead assembly 12. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, ink supply assembly 14, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops that form characters, symbols, and/or other graphics or images on print medium 19. The pattern of ejected ink drops is determined by the print job commands and/or command parameters.

In one embodiment, inkjet printhead assembly 12 includes one printhead 24. In another embodiment, inkjet printhead assembly 12 is a wide-array or multi-head printhead assembly. In one wide-array embodiment, inkjet printhead assembly 12 includes a carrier, which carries printhead dies 24, provides electrical communication between printhead dies 24 and electronic controller 20, and provides fluidic communication between printhead dies 24 and ink supply assembly 14. Printhead dies 24 include vaporization or firing chambers 25, which supply ink that is ejected from nozzles 13.

Ink supply assembly 14 regulates the hydrostatic ink pressure present in printhead 24 at the entrance to firing chambers 25. If the ink pressure inside printhead 24 is too high, the ink will be prematurely forced through nozzles 13 of firing chambers 25 and cause printhead 24 to drool. If the ink pressure inside printhead 24 is too low, the suction created by firing chambers 25 may not be enough to allow firing chambers 25 to refill themselves for the next firing sequence. This condition is commonly referred as "starving the printhead," "printhead starvation," or "nozzle starvation." Therefore, ink supply assembly 14 maintains an optimal ink pressure at the entrance to firing chambers 25 of printhead 24.

Printhead 24 can contain a finite amount of ink. Once the finite amount of ink is consumed, printhead 24 can no longer print. However, printhead 24 may also be continually refilled with ink by an outside source as it prints. In this scenario, printhead 24 has an ink inlet port that is connected with conduit, such as tubing, to ink reservoir 15 providing a supply of ink larger than what printhead 24 by itself can provide. Several reservoirs 15 and/or several printheads 24 can be connected together via an ink manifold. Ink flow through a typical system begins with ink leaving reservoir 15 and passing through several or all of the following elements: to an outlet port on reservoir 15, through one or more manifolds, through a conduit, through an inlet port in printhead 24, through an ink pressure regulating device in printhead 24, and finally to the entrance of the firing chambers 25.

Ink flow through these elements can produce a resistance to ink flow and reduce the pressure of the ink along the flow path. This resistance is commonly referred to as head loss. Furthermore, the head losses due to the ink flow through these elements increases as the velocity of the ink increases. Another source of head loss can result from vertical differences between ink reservoir 15 and the location of printhead 24. Therefore, to overcome the head losses of the printing system and cause ink to flow out of reservoir 15 and into printhead 24, the ink pressure in reservoir 15 must be greater than the ink pressure in printhead 24.

To produce ink flow from ink reservoir 15 to printhead 24, pumping device 23 is used. Pumping device 23 can pump the ink directly or pump the ink through flexible tubes such as by using a peristaltic pump. Another way to produce ink flow is to make ink reservoir 15 out of a flexible container and then compress the container. An air pump can be used to create air pressure that compresses the container. The resulting pressure in the ink reservoir 15 created by pump 23 is referred to as the IDS pressure.

A printhead 24 that is expelling ink at a faster rate will require a greater amount of ink pressure inside reservoir 15 than one that is expelling ink at a slower rate. If the volume of ink leaving firing chambers 25 is smaller than the volume of ink flowing into printhead 24, then the ink pressure at the vaporization chamber 25 entrance will begin to decrease. If the pressure continues to decrease to a level of pressure that is lower than the suction of nozzles 13, ink will no longer flow into firing chamber 25.

There are two key factors that effect the ink flow needed for the printhead: the printhead firing frequency and the image density. The firing frequency is defined as the number of printed columns per second. Practically, the firing frequency can be calculated as the product of the image resolution and the media speed. For example, an image with a resolution of 600 dots per inch (dpi) or columns per inch being printed at 60 inches per second (ips) results in a firing frequency of 36 kHz (or columns per second). The higher the firing frequency, the more often nozzles 13 will eject ink and thus vaporization chambers 25 have to be refilled faster. The result is that the IDS pressure has to be higher.

Density is the second key factor that effects printhead 24 ink consumption. For example, for a printer that prints in only black and white, in a particular column, only the black pixels will need to have their firing chambers 25 refilled. White pixels do not contribute to the ink flow. In one embodiment, a full blackout image being printed at 36 kHz will consume the maximum possible ink.

In one embodiment, electronic controller 20 analyzes data 21 from a density perspective before printing the document and/or file. The outcome of the analysis is an average density of the whole image. For black and white printers, the average density is determined by dividing the number of black dots by the total number of dots. For color printers, the average density of each color in the image is determined separately. With the average density and the firing frequency being used, the ink flow needed for a particular image is calculated and the pressure to be provided by pump 23 is set accordingly. The pressure has to be high enough to keep up with the image needs and avoid printhead starvation, but not excessively high to prevent printhead drool and to extend the life of pump 23 as much as possible.

As a response time for the IDS is on the order of a few seconds, electronic controller 20 analyzes the images and applies the pressure settings within that time in advance. Therefore, some image buffering is used. In one embodiment, for certain applications, such as printing several copies of the same original, only the original is analyzed. For other applications, such as printing addresses on a preprinted form or envelope, even though the data to print is variable, a constant density is assumed and, again, only the first image is analyzed. Each of these print jobs, however, will have different pressure settings depending upon the image content.

Figure 2:
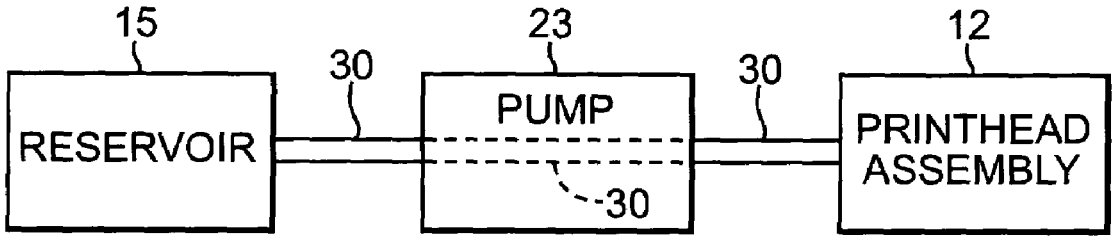
FIG. 2 is a diagram illustrating one embodiment of using a peristaltic pump to supply ink from a reservoir to a printhead assembly.

FIG. 2 is a diagram illustrating one embodiment of using a peristaltic pump for supplying ink from reservoir 15 to printhead assembly 12. In one embodiment, pump 23 is a peristaltic pump having at least one compressible pump tube 30, as is known in the art. Generally, ink is moved through pump tube 30 by the application of a compressive force to pump tube 30, such as by pressing a roller (not shown) against pump tube 30 with sufficient force so as to create an occlusion within pump tube 30. The roller (and thus the occlusion) is moved along the length of pump tube 30, such that ink is forcibly transported ahead of the occlusion. Commonly, a series of rollers are used to create a plurality of successive occlusions along the length of pump tube 30, such that a peristaltic pumping action is created along the length of pump tube 30.

In one embodiment, the speed of peristaltic pump 23 is set by electronic controller 20 based on the image density and the firing frequency to be used. The speed of peristaltic pump 23 is optimized to provide the IDS pressure needed to provide an adequate flow of ink to printhead assembly 12 and prevent printhead starvation and printhead drool. By optimizing the IDS pressure provided by peristaltic pump 23, the life of peristaltic pump 23 can be lengthened.

Figure 3:
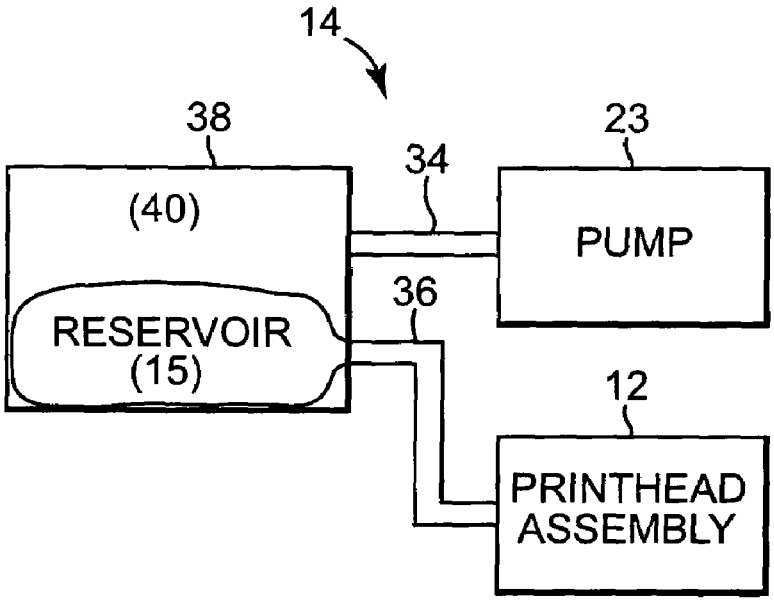
FIG. 3 is a diagram illustrating one embodiment of using an air pump to supply ink from a reservoir to a printhead assembly.

FIG. 3 is a diagram illustrating one embodiment of using an air pump for pressurizing ink in reservoir 15 to supply printhead assembly 12. In this embodiment, ink supply assembly 14 includes an air pump 23 and a container 38 comprising a space 40 for air and a flexible ink reservoir 15. Air pump 23 provides air through tubing 34 to space 40 within container 38. The air in space 40 pressurizes flexible ink reservoir 15 to force ink from ink reservoir 15 through tubing 36 to printhead assembly 12.

In one embodiment, the pressure provided by air pump 23 into space 40 to compress flexible ink reservoir 15 is set by electronic controller 20 based on the image density and the firing frequency used. The air pressure provided by air pump 23 is optimized to provide the IDS pressure needed to provide an adequate flow of ink to printhead assembly 12 and prevent printhead starvation and printhead drool. By optimizing the IDS pressure provided by air pump 23, the life of air pump 23 can be lengthened.

For example, the volume of air needed to pressurize flexible ink reservoir 15 to 1.0 psi is less than the volume of air needed to pressurize flexible ink reservoir 15 to 5.0 psi. Over the life of air pump 23, if the majority of images printed required 1.0 psi, then air pump 23 will have pumped much less air than an air pump that operated at a constant pressure of 5.0 psi. Air pump 23 also runs less frequently than an air pump operated at a constant pressure. Since the life of an air pump is rated in terms of volume of air-pumped, a system that adjusts the air pressure can extend the life of the air pump over a system that maintains a constant air pressure set to allow the maximum flow rate.

Figure 4:
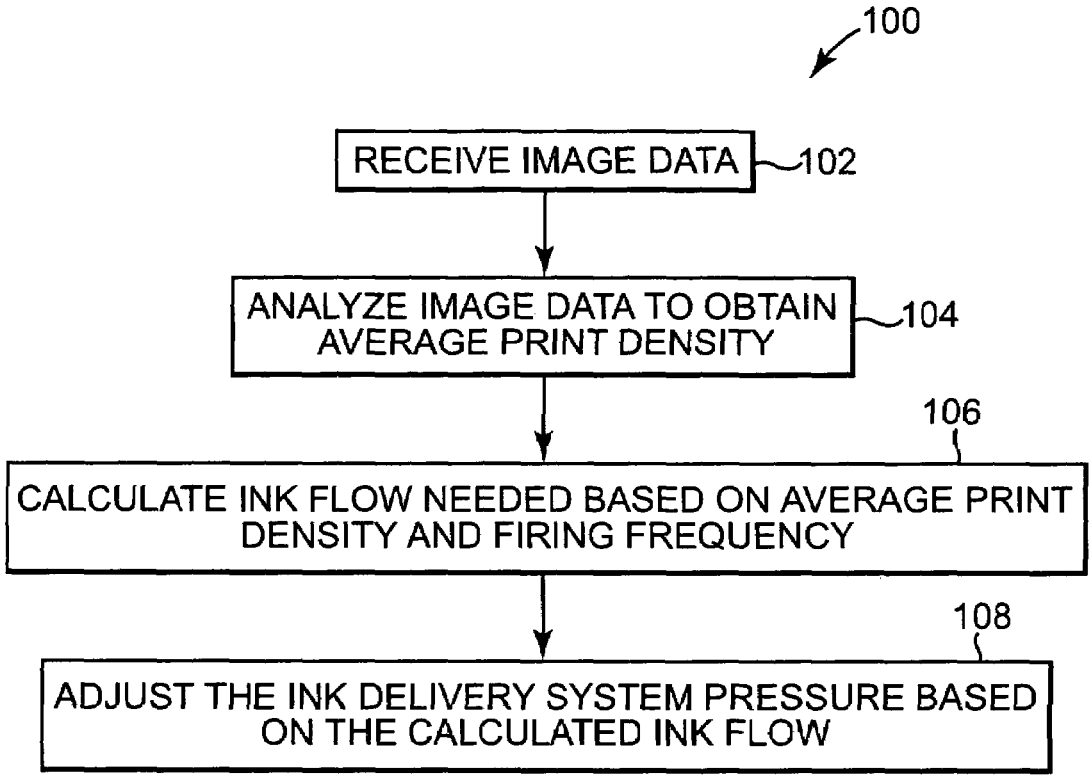
FIG. 4 is a flow diagram illustrating one embodiment of a method for adjusting the pressure of an ink delivery system based on a calculation of ink flow.

FIG. 4 is a flow diagram illustrating one embodiment of a method 100 for adjusting the IDS pressure. At 102, electronic controller 20 receives image data 21 from a host. At 104, electronic controller 20 analyzes the image data to obtain an average print density. At 106, electronic controller 20 calculates the ink flow needed based on the average print density and the firing frequency used. At 108, electronic controller 20 adjusts the IDS pressure of pump 23 based on the calculated ink flow.

Embodiments of the present invention control the IDS pressure based on how much ink each image consumes. The IDS pressure is calculated based on the density of each image and the firing frequency used. As a result, with these embodiments, printhead starvation and printhead drool are prevented, the print quality of images having large dark areas is improved, and printhead thermal shutdowns are prevented. In one embodiment, the IDS pump provides only the amount of ink pressure that is warranted by the print density and firing frequency. Therefore, the IDS pump in this embodiment does not have to work under higher load conditions for images having a lower print density and/or firing frequency, such that the life of the pump is increased.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. An ink delivery system for a printer, the ink delivery system comprising:

an ink reservoir;

a printhead assembly including a vaporization chamber;

a pump configured to provide ink from the ink reservoir to the printhead assembly at a selected pressure; and a controller configured to adjust the selected pressure based on a characteristic of an image to be printed and on a firing frequency of the vaporization chamber to prevent printhead starvation.

2. The ink delivery system of claim 1, wherein the characteristic of the image is a density of the image.

3. The ink delivery system of claim 1, wherein the pump comprises an air pump.

4. The ink delivery system of claim 1, wherein the pump comprises a peristaltic pump.

5. The ink delivery system of claim 1, wherein the ink reservoir comprises a flexible ink reservoir.

6. The ink delivery system of claim 1, wherein the controller is configured to adjust the selected pressure to prevent printhead drool.

7. A printer comprising:

a printhead assembly comprising a printhead including a vaporization chamber;

an ink supply assembly comprising an ink reservoir and a pump, the pump configured to provide ink from the ink reservoir to the printhead at a selected pressure; and a controller configured to adjust the selected pressure based on a density of an image to be printed and on a firing frequency of the vaporization chamber to prevent printhead starvation.

8. The printer of claim 7, wherein the firing frequency is less than or equal to 36 kHz.

9. The printer of claim 7, wherein the ink reservoir comprises a flexible ink reservoir, and wherein the pump comprises an air pump configured to pressurize the flexible ink reservoir to provide ink from the ink reservoir to the printhead.

10. The printer of claim 7, wherein the pump comprises a peristaltic pump.

11. The printer of claim 7, wherein the controller is configured to adjust the selected pressure based on an average density of the image to be printed.

12. The printer of claim 7, wherein the controller is configured to adjust the selected pressure to a higher pressure in response to a higher density and to a lower pressure in response to a lower density.

13. A printer comprising:

means for analyzing an image to be printed to determine an image characteristic; and means for adjusting a pump to provide a selected ink pressure to a printhead based on the image characteristic and on a firing frequency of a vaporization chamber of the printhead to prevent printhead starvation.

14. The printer of claim 13 wherein the image characteristic is an image density.

15. A method for pressurizing ink in a printer, the method comprising:

analyzing an image to be printed to determine a density of the image; and adjusting a pump to provide a selected ink pressure to a printhead based on the density of the image and on a firing frequency of a vaporization chamber of the printhead to prevent printhead starvation.

16. The method of claim 15, comprising:

providing an air pump configured to pressurize a flexible ink reservoir.

17. The method of claim 16, wherein adjusting the pump to provide the selected ink pressure comprises adjusting an air pressure of the air pump to pressurize the flexible ink reservoir.

18. A controller for a printer that includes a pump system to provide ink from an ink reservoir to a printhead assembly including a printhead, comprising:

means for analyzing an image to determine an image density; and means for adjusting a parameter of the pump system based on the determined image density and on a firing frequency of a vaporization chamber of the printhead to prevent printhead starvation.

19. A printer comprising:

a printhead assembly comprising a printhead including a aporizati on chamber;

an ink supply assembly comprising an ink reservoir and a pump, the pump configured to provide ink from the ink reservoir to the printhead at a selected pressure; and a controller configured to adjust the selected pressure based on a density of an image to be printed and on a firing frequency of the vaporization chamber, wherein the firing frequency is less than or equal to 36 kHz.

* * * * *

UNITED STATES PATENT AND TRADEMARK OFFICE

CERTIFICATE OF CORRECTION

PATENT NO. : 7,455,377 B2
APPLICATION NO. : 11/081492
DATED : November 25, 2008
INVENTOR(S) : Cesar Fernandez Espasa et al.

It is certified that error appears in the above-identified patent and that said Letters Patent is hereby corrected as shown below:

In column 8, line 33, in Claim 19, delete “aporizati on” and insert -- vaporization --, therefor.

Signed and Sealed this

Twenty-sixth Day of May, 2009

JOHN DOLL
*Acting Director of the United States Patent and Trademark Office*